US008083220B2

(12) United States Patent
Kato et al.

(10) Patent No.: US 8,083,220 B2
(45) Date of Patent: Dec. 27, 2011

(54) SHEET PROCESSING APPARATUS

(75) Inventors: Hitoshi Kato, Toride (JP); Tsuyoshi Moriyama, Toride (JP); Yasuo Fukatsu, Abiko (JP); Naoki Ishikawa, Kashiwa (JP)

(73) Assignee: Canon Kabushiki Kaisha (JP)

( * ) Notice: Subject to any disclaimer, the term of this patent is extended or adjusted under 35 U.S.C. 154(b) by 197 days.

(21) Appl. No.: 12/569,366

(22) Filed: Sep. 29, 2009

(65) Prior Publication Data

US 2010/0078868 A1 Apr. 1, 2010

(30) Foreign Application Priority Data

Sep. 30, 2008 (JP) ..... 2008-253843
Sep. 28, 2009 (JP) ..... 2009-221833

(51) Int. Cl.
*B65H 39/00* (2006.01)

(52) U.S. Cl. ..... 270/58.1; 270/58.07; 270/58.02; 270/58.11

(58) Field of Classification Search ..... 270/58.1, 270/58.07, 58.02, 58.11
See application file for complete search history.

(56) References Cited

U.S. PATENT DOCUMENTS 7,413,178 B2 8/2008 Fujii et al.

FOREIGN PATENT DOCUMENTS

JP 2007-070079 A 3/2007

*Primary Examiner* — Leslie A Nicholson, III

(74) *Attorney, Agent, or Firm* — Rossi, Kimms & McDowell LLP

(57) ABSTRACT

A sheet processing apparatus capable of reliably superposing a sheet to be buffered and a following sheet in a manner displaced by an allowable displacement amount, thereby making it possible to suppress generation of misalignment. A sheet discharged from an image forming apparatus is temporarily held back, and a following sheet is superposed on the held-back sheet in a state displaced in a conveying direction. A length in the conveying direction of the sheet to be held back and a length in the conveying direction of a sheet bundle of the superposed sheets are measured. A displacement amount provided between the superposed sheets, computed as a difference between the measured length of the sheet and the measured length of the sheet bundle, is adjusted such that the displacement amount becomes a target displacement amount.

10 Claims, 13 Drawing Sheets

SHEET PROCESSING APPARATUS

BACKGROUND OF THE INVENTION

1. Field of the Invention

The present invention relates to a sheet processing apparatus that performs post-processing on sheets having images formed thereon.

2. Description of the Related Art

In recent years, as an optional device that is connected to an image forming apparatus, such as a laser beam printer, there has been proposed a sheet processing apparatus that performs post-processing, such as a sorting process for sorting sheets having images formed thereon, and a stapling process for stapling a plurality of sheets having images formed thereon into one bundle.

When the stapling process is performed, it is required for the sheet processing apparatus to complete a process for aligning a set of sheets to be stapled and stapling the aligned set of sheets into a bundle within a time period corresponding to a time interval between when the last sheet of one set of sheets is conveyed and when the first sheet of a next set of sheets is conveyed. However, if the time interval of conveyance between the above-mentioned two sheets is short, the first sheet of the next set is sometimes conveyed in during execution of the process for stapling the sheet bundle of the one set, which prevents the process from being completed.

To cope with such a problem, there has been proposed a sheet processing apparatus that, during performing the process for stapling a sheet bundle of one set of sheets, causes first several sheets of a next set of sheets to be temporarily held back in a buffer path, thereby securing a time period for completing the process for stapling the sheet bundle of the one set of sheets.

For example, there has been proposed a method of securing a time period for completing the process for stapling a sheet bundle of one set of sheets, by wrapping sheets around a buffer roller as a buffer path (U.S. Pat. No. 7,413,178).

In this method, a first sheet S1 of one set is wrapped around the buffer roller. Thereafter, a sheet S2 conveyed following the sheet S1 at a predetermined timing is wrapped on the sheet S1, and the two sheets are conveyed as one sheet bundle. At this time, the sheets S1 and S2 are superposed one upon the other in an offset state (displaced state) in the conveying direction. At this time, the sheets S1 and S2 are offset such that a leading end of the sheet S2 protrudes from a leading end of the sheet S1 (protrudes downstream in the conveying direction). This offset is necessary for properly aligning the superposed sheets S1 and S2 on an intermediate processing tray. Further, a displacement amount in the conveying direction between the sheets S1 and S2 superposed in the offset manner, i.e. an offset amount is determined depending on timing in which the sheet S1 is sent out.

Then, the sheet bundle formed by the superposed sheets S1 and S2 is discharged onto the intermediate processing tray, and is aligned thereon.

A description will be given of how a sheet bundle formed by a plurality of superposed sheets is aligned, with reference to FIG. 12. FIG. 12 schematically shows the sheet bundle formed by the superposed sheets in a state discharged onto the intermediate processing tray.

As shown in FIG. 12, the sheet bundle formed by the superposed sheets S1 and S2 is discharged onto the intermediate processing tray 138 by a lower conveying roller 128. At this time, the sheet bundle is conveyed with the leading end thereof nipped between a bundle discharge roller pair 130. Then, when the sheet bundle passes through the lower conveying roller 128 and is placed on the intermediate processing tray 138, the rotation of the bundle discharge roller pair 130 is reversed, whereby the sheet bundle is conveyed toward a rear end stopper 138*a* disposed on the intermediate processing tray 138.

Thereafter, the bundle discharge roller pair 130 is separated from each other, whereby each of the sheets S1 and S2 of the sheet bundle is moved by inertia toward the rear end stopper 138*a*, which brings the rear end thereof into abutment with the rear end stopper 138*a*. At the start of this downward movement of each of the sheets S1 and S2, the sheet S1 under the sheet S2 is in a state offset from the sheet S2 such that the trailing end of the sheet S1 is closer to the rear end stopper 138*a* than that of the sheet S2 is. Therefore, the trailing end of the sheet S1 is the first to be brought into abutment with the rear end stopper, and the trailing end of the sheet S2 is the next.

As described above, the sheets S1 and S2 are offset such that the rear ends thereof are sequentially brought into abutment with the rear stopper, from the sheet S1 in the lower position in the sheet bundle first, whereby the alignment of the sheets S1 and S2 in the conveying direction is properly performed.

Now, the above-mentioned offset amount is determined depending on whether or not the sheet bundle formed by the plurality of superposed sheets can be aligned on the intermediate processing tray, and is set to a fixed value (usually, not less than 1 mm).

Further, the number of sheets to be buffered, i.e. the number of sheets to have a sheet superposed thereon is determined depending on the length of a time period required to execute post-processing, the conveying capacity of a conveying path, etc.

However, when a sheet to be buffered and a following sheet are superposed one upon the other, there is a case where the offset amount in the conveying direction between the buffered sheet and the following sheet does not become equal to a predetermined offset amount. Presumably, this is caused by deflection of sheets in the conveying path in the conveying direction of the sheet due to a property (elasticity) of a material of the above-mentioned sheet, etc. In case a plurality of sheets forming a sheet bundle which are superposed as described above with a different offset amount from the predetermined offset amount are subjected to alignment on the intermediate processing tray, there is a case where it is impossible to reliably perform alignment of the sheets, causing misalignment.

To cope with this problem, a technique for always maintaining a fixed offset amount has been proposed (Japanese Laid-Open Patent Publication No. 2007-070079). According to this publication, the length of a sheet bundle formed by superposing a sheet S1 and a sheet S2 one upon the other on a buffer roller is measured, and if the measured length is longer than a predetermined length, the offset amount applied to superposition of sheets performed next time is reduced.

However, a sheet discharged from an image forming apparatus of an electrophotographic type is contracted when passing through a heat fixing device. Further, the amount of contraction of the sheet varies with the properties of a material of the sheets, the amount of toner transferred onto the sheet, the water content of the sheet, etc.

However, the technique proposed in Japanese Laid-Open Patent Publication No. 2007-070079 does not take the contraction of each sheet into account, which makes it impossible to accurately adjust the offset amount. As a result, there is a fear that it becomes impossible to accurately align sheets on the intermediate processing tray.

SUMMARY OF THE INVENTION

The present invention provides a sheet processing apparatus that solves the above-described problem.

The present invention further provides a sheet processing apparatus which is capable of reliably superposing a sheet to be buffered and a following sheet one upon the other in a manner displaced by an allowable displacement amount, thereby making it possible to suppress generation of misalignment.

In a first aspect of the present invention, there is provided a sheet processing apparatus for performing post-processing on sheets conveyed from an image forming apparatus, comprising a buffer section configured to cause a sheet conveyed from the image forming apparatus to be temporarily held back therein, and superpose the held-back sheet and a following sheet in a state displaced in a conveying direction of the sheet, a tray configured to stack thereon a sheet bundle superposed by the buffer section and conveyed, an alignment unit configured to align the sheet bundle stacked on the tray in the conveying direction, a first measurement section configured to measure a length in the conveying direction of the sheet to be held back in the buffer section, a second measurement section configured to measure a length in the conveying direction of the sheet bundle of the superposed sheets, and an adjustment section configured to adjust a displacement amount in the conveying direction of the sheets superposed by the buffer section, the adjustment section adjusting the displacement amount, such that a difference between a result of measurement by the first measurement section and a result of measurement by the second measurement section is caused to be a target amount.

In a second aspect of the present invention, there is provided a sheet processing apparatus for performing post-processing on sheets conveyed from an image forming apparatus, comprising a buffer section configured to cause a sheet conveyed from the image forming apparatus to be temporarily held back therein, and superpose the held-back sheet and a following sheet in a state displaced in a conveying direction of the sheet, a tray configured to stack thereon a sheet bundle superposed by the buffer section and conveyed, an alignment unit configured to align the sheet bundle stacked on the tray in the conveying direction, a first measurement section configured to measure a length in the conveying direction of the sheet to be held back in the buffer section, a second measurement section configured to measure a length in the conveying direction of the sheet bundle of the superposed sheets, and a computing section configured to compute a displacement amount in the conveying direction of the sheets superposed by the buffer section based on a difference between a result of measurement by the first measurement section and a result of measurement by the second measurement section.

According to the present invention, it is possible to reliably superpose a sheet to be buffered and a following sheet in a manner displaced by an allowable displacement amount, thereby making it possible to suppress generation of misalignment.

Further features of the present invention will become apparent from the following description of exemplary embodiments (with reference to the attached drawings).

DETAILED DESCRIPTION OF THE EMBODIMENTS

The present invention will now be described in detail below with reference to the accompanying drawings showing embodiments thereof.

Figure 1:
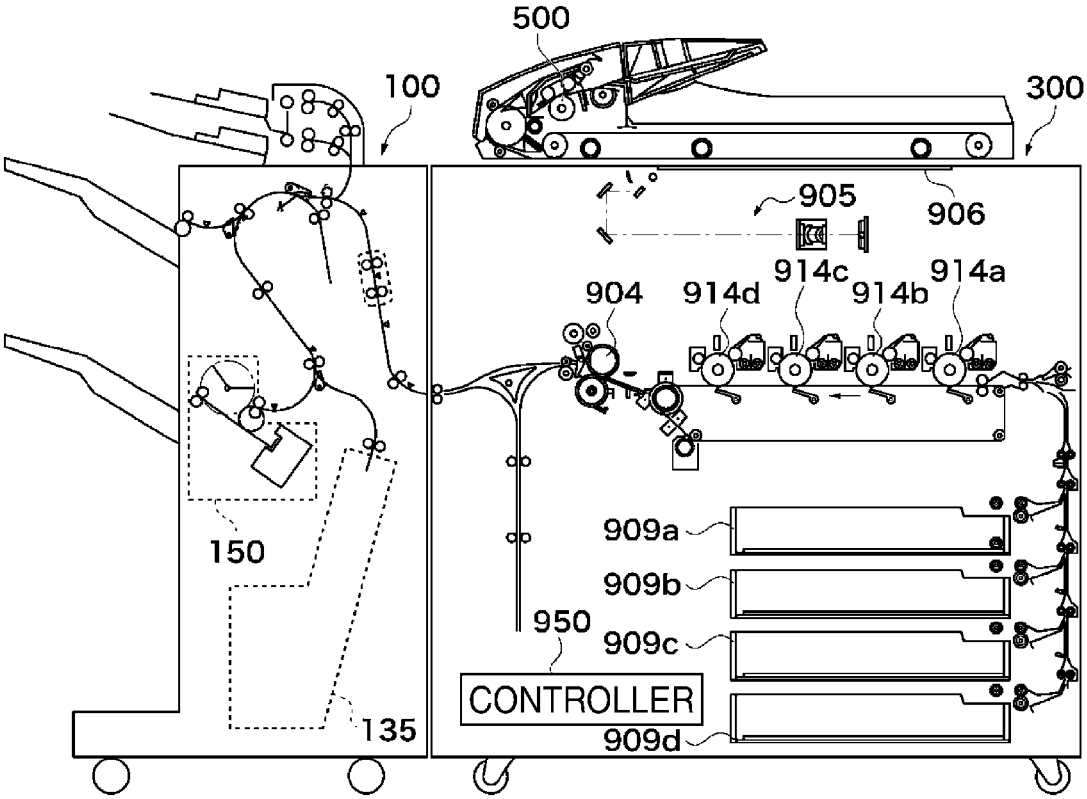
FIG. 1 is a longitudinal cross-sectional view schematically showing the arrangement of an image forming apparatus incorporating a sheet processing apparatus according to a first embodiment of the present invention is connected.

FIG. 1 is a schematic longitudinal cross-sectional view of an image forming apparatus incorporating a sheet processing apparatus according to a first embodiment of the present invention.

As shown in FIG. 1, the image forming apparatus of the present embodiment is comprised of a color copying machine (hereinafter referred to as "the copying machine") 300, and a sheet processing apparatus 100 which is connected to the copying machine 300. Here, the copying machine 300 includes a document feeder 500, a scanner 905, a plurality of cassettes 909*a* to 909*d*, a plurality of image forming units 914*a* to 914*d*, a fixing device 904, and a controller 950.

The document feeder 500 sequentially feeds set originals onto a platen glass 906. The scanner 905 reads an original fed onto the platen glass 906, and outputs image data of the original, which is obtained by the reading. The output image data is converted into image data of respective colors of yellow, magenta, cyan, and black.

Each of the image forming units 914*a* to 914*d* receives image data of an associated color, and forms a toner image of the associated color based on the input image data. The toner images formed by the respective image forming units 914*a* to 914*d* are transferred onto a sheet fed from one of the cassettes 909*a* to 909*d*, in superimposed relation. Thus, a full-color toner image is transferred on the sheet, and the sheet is conveyed to the fixing device 904.

The fixing device 904 heats and presses the sheet having the toner image transferred thereon, to thereby fix the toner image on the sheet. Thus, a full-color image is formed on the sheet, and the sheet is conveyed to the sheet processing apparatus 100.

The sheet processing apparatus 100 includes a saddle stitch unit 135, and a side stapling unit 150. Each of the saddle stitch unit 135 and the side stapling unit 150 is capable of processing sheets discharged from the copying machine 300 online. The side stapling unit 50 is capable of stacking the sheets as a bundle, and performing stapling on the sheet bundle using staples.

The controller 950 of the copying machine 300 controls not only the copying machine 300, but also the sheet processing apparatus 100.

The copying machine 300 can be used alone, and the sheet processing apparatus 100 is an optional device that is connected to the copying machine 300 as required. Alternatively, the image forming apparatus may integrally comprise the copying machine 300 and the sheet processing apparatus 100.

Figure 2:
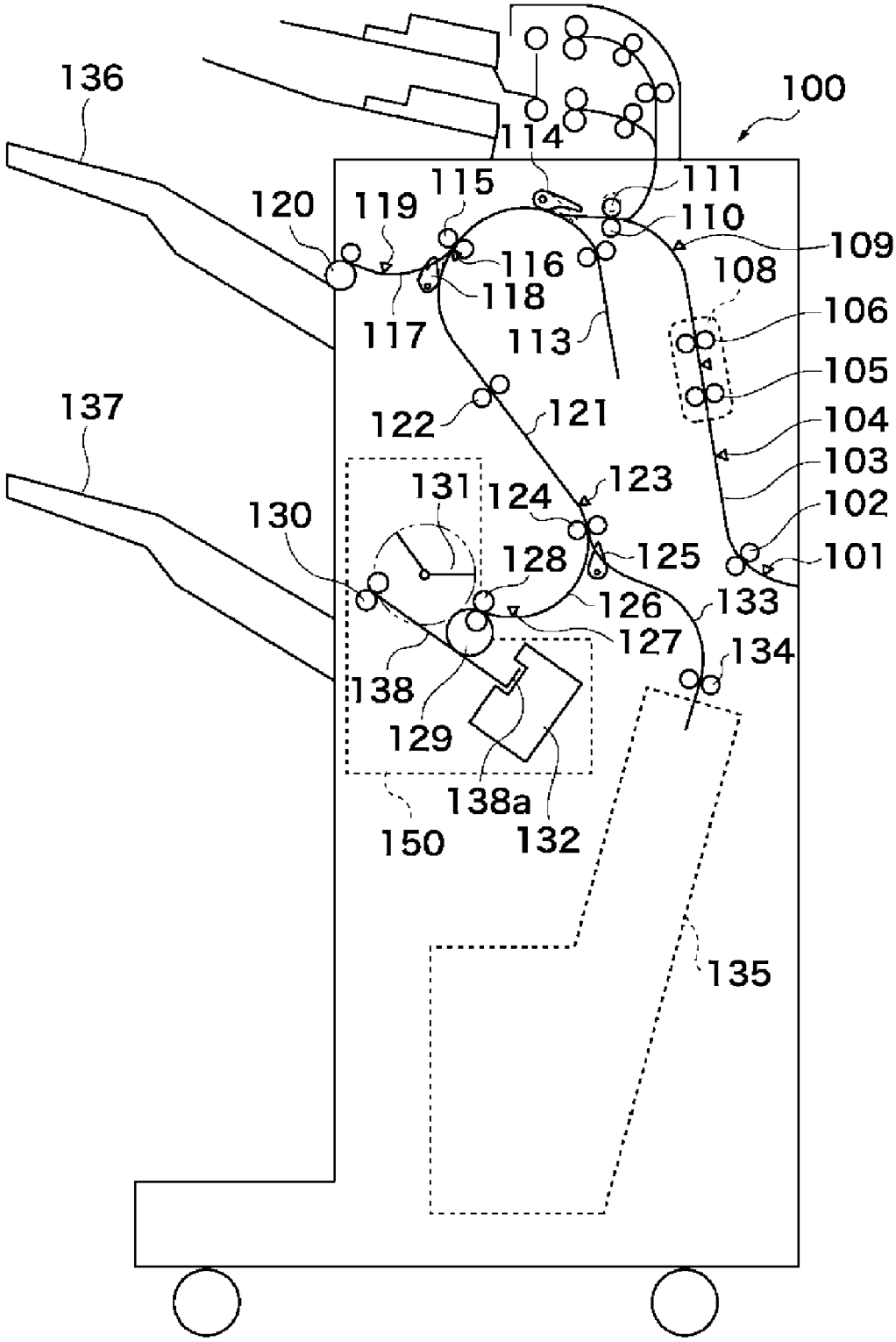
FIG. 2 is a longitudinal cross-sectional view showing the arrangement of essential parts of the sheet processing apparatus appearing in FIG. 1.

Next, a description will be given of essential parts of the sheet processing apparatus 100 with reference to FIG. 2. FIG. 2 is a schematic longitudinal cross-sectional view of the essential parts of the sheet processing apparatus 100 in FIG. 1.

As shown in FIG. 2, the sheet processing apparatus 100 includes an inlet roller pair 102 which receives a sheet having an image formed thereon from the copying machine 300 and conveys the same into a conveying path 103. An inlet sensor 101 is disposed at a location upstream of the inlet roller pair 102, and timing at which a sheet is received from the copying machine 300 is detected based on an output from the inlet sensor 101.

The above-mentioned conveying path 103 is provided with a lateral registration sensor 104 for detecting an end of the sheet conveyed therealong. The lateral registration sensor 104 is disposed at a location before a shift unit 108. Based on an output from the lateral registration sensor 104, a displacement amount in a direction orthogonal to the sheet conveying direction from a reference position of the sheet is detected.

The shift unit 108 includes two shift roller pairs 105 and 106. The shift unit 108 moves the sheet by the displacement amount detected based on the output from the lateral registration sensor 104 in the direction orthogonal to the sheet conveying direction, while the sheet is being conveyed in a state nipped by each of the shift roller pairs 105 and 106. This returns the sheet to the reference position.

The sheet which has passed through the shift unit 108 is conveyed by a conveying roller 110 and a separation roller 111 which are opposed to each other, and is conveyed via a flapper 114 to a buffer roller pair 115. A buffer sensor 109 is disposed in an intermediate portion of a passage between the shift unit 108 and the conveying roller 110.

The buffer roller pair 115 serves as a roller pair which is capable of conveying a sheet or a sheet bundle formed by superposing a plurality of sheets. On an exit side of the above-mentioned buffer roller pair 115, a flapper 118 is disposed which is moved to a position for guiding the sheet to an upper conveying path 117 or a position of guiding the same to a bundle-conveying path 121. Here, a sheet is halfway sidetracked into a buffer path (buffer section) 113, so as to be temporarily held back therein. Thereafter, the sheet is sent out from the buffer path 113 so as to have a next sheet (following sheet) superposed thereon at predetermined timing, whereby a sheet bundle is formed. A buffering process for causing the above-mentioned sheet to be halfway sidetracked into the buffer path 113 will be described hereinafter. Further, a buffer sensor 116 is disposed on the exit side of the buffer roller pair 115. That is, the buffer sensor 109 functions as a sensor for detecting arrival of a sheet, and for measuring the length of the sheet. The buffer sensor 116 functions as a sensor for detecting arrival of a sheet, and for measuring a length of a sheet bundle.

The sheet conveyed into the conveying path 117 is discharged onto an upper tray 136 by an upper discharge roller pair 120. A sheet sensor 119 for detecting a sheet jam is disposed on the upper conveying path 117.

A sheet or a sheet bundle is sent to the above-mentioned bundle-conveying path 121, and the sheet or the sheet bundle is conveyed by a buffer roller pair 122 and a bundle-conveying roller pair 124. Then, the sheet or the sheet bundle is sent to a saddle stitch path 133 or a lower conveying path 126 by a flapper 125. A sheet sensor 123 is disposed at a location before the bundle-conveying roller pair 124.

The sheet or the sheet bundle guided into the saddle stitch path 133 is conveyed into the saddle stitch unit 135 by a saddle inlet roller pair 134. The construction of the saddle stitch unit 135 is well known, and hence a description thereof is omitted.

The sheet or the sheet bundle guided into the lower conveying path 126 is conveyed through a lower discharge roller pair 128 into the side stapling unit 150. The side stapling unit 150 has an intermediate processing tray 138. The sheet or the sheet bundle is discharged by the lower discharge roller pair 128 onto the intermediate processing tray 138, and has a next sheet or a next sheet bundle superposed thereon, whereby sheets or sheet bundles are stacked in the form of a bundle. At this time, alignment processing for aligning ends of the respective superposed sheets is performed by the operations of a bundle discharge roller pair 130, a paddle 131, and so forth. Then, when a number of sheets required to form one copy set are stacked as a bundle on the intermediate processing tray 138, the sheets are stapled into one bundle by a stapler 132, as required. That is, side stapling is executed. A sheet bundle stapled by the stapler 132 or an unstapled sheet bundle is discharged onto a lower tray 137 by the bundle discharge roller pair 130.

The above-mentioned bundle discharge roller pair 130 is switched between a contact state and a separate state depending on whether or not the buffering process using the buffer path 113 is performed. This switching is carried out by a separation mechanism, not shown.

Now, if the buffering process is not performed, one sheet each is discharged and is stacked on the intermediate processing tray 138. In this case, the bundle discharge roller pair 130 is in the separate state. The sheet discharged on the intermediate processing tray 138 is conveyed back by the paddle 131 and a knurled belt 129 such that a trailing end of the sheet is brought into abutment with a rear end stopper 138*a* of the intermediate processing tray 138. This causes sheets stacked on the intermediate processing tray 138 to be aligned in the conveying direction.

On the other hand, if the buffering process is performed, a sheet bundle formed by a plurality of superposed sheets is discharged onto the intermediate processing tray 138. More specifically, the sheet bundle is discharged onto the intermediate processing tray 138, while having its leading end received and nipped between the bundle discharge roller pair 130. Then, the rotation of the bundle discharge roller pair 130 is reversed, whereby the sheet bundle is conveyed back and the rear end thereof is brought into abutment with the rear end stopper 138*a* of the intermediate processing tray 138. This causes the sheets stacked on the intermediate processing tray 138 to be aligned in the conveying direction.

Figure 3:
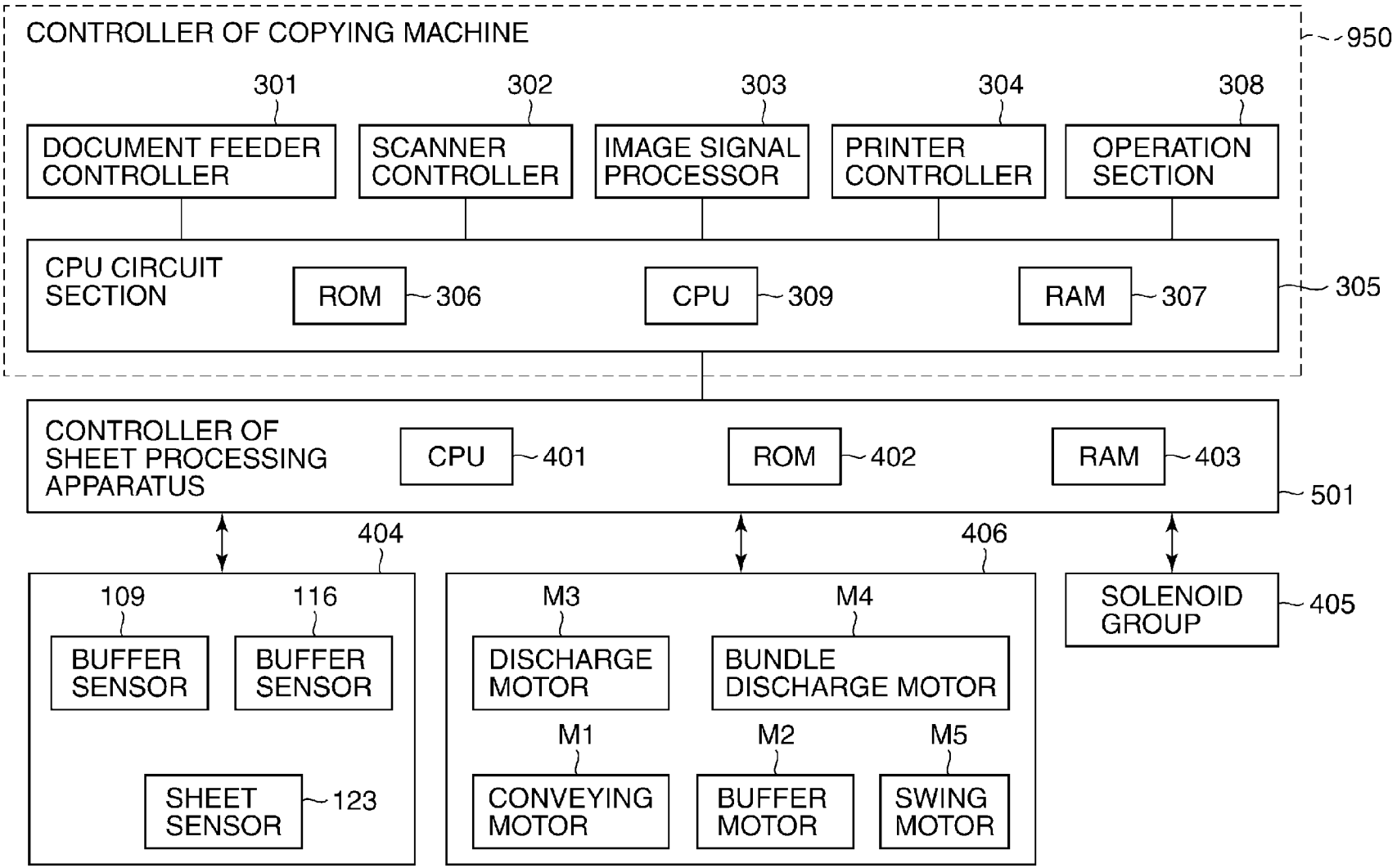
FIG. 3 is a block diagram showing the arrangement of a controller of a copying machine appearing in FIG. 1 and a controller of the sheet processing apparatus.

Next, the configuration of control in the present embodiment will be described with reference to FIG. 3. FIG. 3 is a block diagram of the controller 950 of the copying machine 300 and a controller 501 of the sheet processing apparatus 100 appearing in FIG. 3.

As shown in FIG. 3, the controller 950 of the copying machine 300 includes a CPU circuit section 305. The CPU circuit section 305 is comprised of a CPU 309, a ROM 306 which stores control programs executed by the CPU 309, and a RAM 307 which provides a work area for the CPU 309. A document feeder controller 301, a scanner controller 302, an image signal processor 303, a printer controller 304, and an console section 308 are connected to the CPU circuit section 305. Further, the CPU circuit section 305 is provided with an interface, not shown, for connection to the controller 501 of the sheet processing apparatus 100, whereby the CPU circuit section 305 communicates with the controller 501 of the sheet processing apparatus 100 via the above-mentioned interface. The CPU circuit section 305 controls the above-mentioned components to thereby carry out respective associated operations according to the control programs stored in the ROM 306.

The document feeder controller 301 controls the operation of the document feeder 500 (see FIG. 1) based on instructions from the CPU circuit section 305. The scanner controller 302 controls the operation of the scanner 905 (see FIG. 1) based on instructions from the CPU circuit section 305.

The image signal processor 303 converts RGB analog image signals output from the scanner 905 into digital image signals based on instructions from the CPU circuit section 305, and performs processing on each of the digital image signals. The digital image signals are converted into video signals and are delivered to the printer controller 304.

The printer controller 304 controls the respective operations of the image forming units 914*a* to 914*d*, the fixing device 904 (see FIG. 1), and so forth, based on instructions from the CPU circuit section 305, to thereby print out the video signals from the image signal processor 303.

The console section 308 includes a plurality of keys for configuring various functions for image forming operation, and a display section for displaying information indicative of settings. A key signal associated with each key operation of the console section 308 is input to the CPU circuit section 305. Further, on the display section of the console section 308 is displayed information, such as apparatus status information, set mode information, and warning information, output from the CPU circuit section 305.

The controller 501 is incorporated in the sheet processing apparatus 100, and controls the operation of the sheet processing apparatus 100 based on instructions from the CPU circuit section 305. The controller 501 includes a CPU 401, a ROM 402, and a RAM 403. The CPU 401 controls the operation of each solenoid of a solenoid group 405 and that of each motor of a motor group 406 according to control programs stored in the ROM 402, while monitoring output from each sensor of a sensor group 404. The RAM 403 provides a work area for the CPU 401.

The above-mentioned sensor group 404 includes a plurality of sensors, such as the inlet sensor 101, the buffer sensors 109 and 116, the sheet sensors 119 and 123, and a sheet sensor 127 (see FIG. 2). In FIG. 3, the buffer sensors 109 and 116, and the sheet sensor 123 are shown, but the other sensors are not shown. The above-mentioned solenoid group 405 includes solenoids, not shown, for operating the flappers 114, 118, and 125, respectively (see FIG. 2).

The above-mentioned motor group 406 includes a conveying motor M1, a buffer motor M2, a discharge motor M3, a bundle discharge motor M4, and a swing motor M5. The motor group 406 further includes motors, not shown, for driving the shift unit 108, the paddle 131, the knurled belt 129, the stapler 132, and so forth, respectively. The motor group 406 further includes motors, not shown, for lifting up and down the upper tray 136 and the lower tray 137, respectively.

Now, the conveying motor M1 serves as a motor for driving the inlet roller pair 102, the shift roller pairs 105 and 106, and the conveying roller 110, for rotation in an interlocked manner. The buffer motor M2 serves as a motor for driving a buffer roller pair 112 and the buffer roller pair 115, for rotation in an interlocked manner. The discharge motor M3 serves as a motor for driving the upper discharge roller pair 120, the buffer roller pair 122, the bundle-conveying roller pair 124, and the lower discharge roller pair 128, for rotation. The bundle discharge motor M4 serves as a motor for driving the bundle discharge roller pair 130, for rotation. The swing motor M5 serves as a motor for separating the bundle discharge roller pair 130 from each other.

Figure 4:
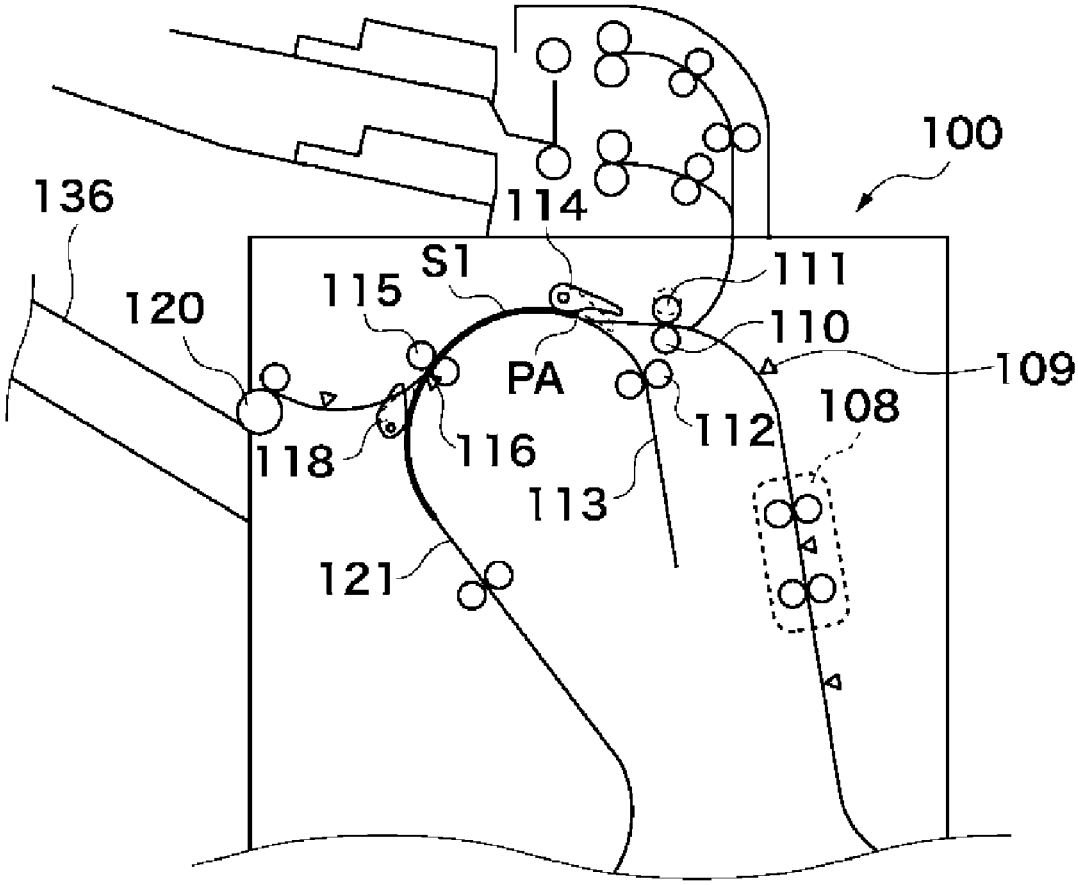
FIG. 4 is a view schematically showing a conveying state of a preceding sheet during a buffering process.
Figure 5:
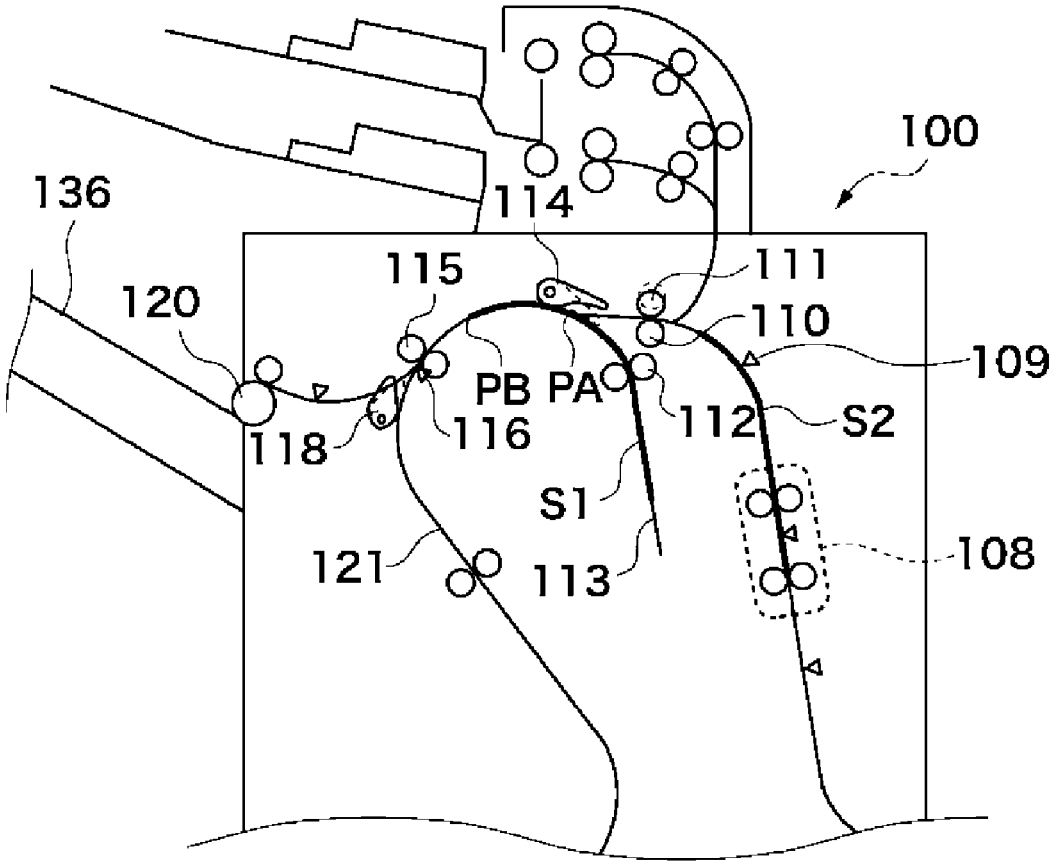
FIG. 5 is a view schematically showing a conveying state of the preceding sheet and a following sheet which follows the preceding sheet during the buffering process.
Figure 6:
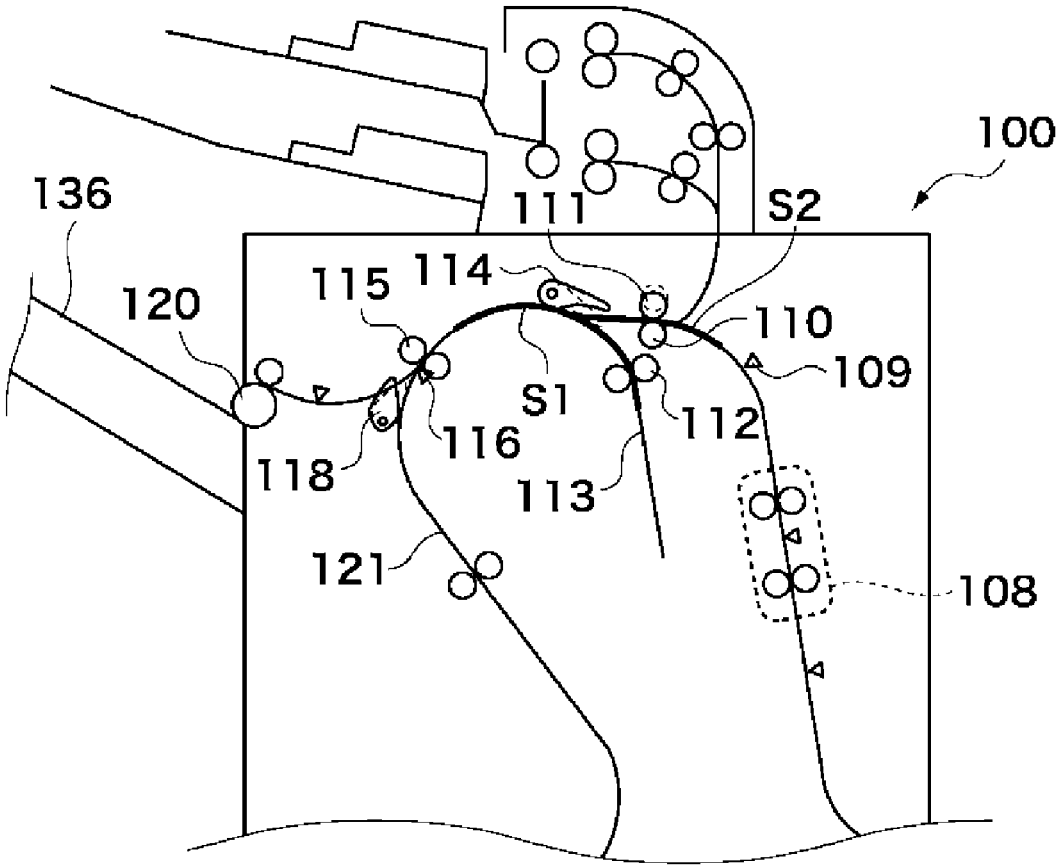
FIG. 6 is a view schematically showing a state in which the preceding sheet and the following sheet are conveyed in an superposed state during the buffering process.

Next, a description will be given of the buffering process in the present embodiment with reference to FIGS. 4 to 6. FIG. 4 is a view schematically showing a conveying state of a preceding sheet during the buffering process. FIG. 5 is a view schematically showing a conveying state of the preceding sheet and a following sheet which follows the preceding sheet, for buffering, during the buffering process. FIG. 6 is a view schematically showing a state in which the preceding sheet and the following sheet are conveyed in an superposed state during the buffering process.

In the case of side stapling, the sheets are discharged from the copying machine 300 to the sheet processing apparatus 100 at regular intervals, and are conveyed to the side stapling unit 150. Then, the sheets are superposed in a bundle on the intermediate processing tray 138. The alignment process for aligning respective ends of the sheets is performed on the sheets superposed in a bundle. After performing this alignment process, the sheet bundle is stapled by the stapler 132. Then, the stapled sheet bundle is discharged onto the lower tray 137.

Here, if a time period required to complete execution of side stapling is longer than a time period corresponding to an interval of sheet discharge, a first sheet of a second copy set of the sheet bundle is discharged onto the intermediate processing tray 138 during execution of side stapling of a first copy set of the sheet bundle, which makes it impossible to complete side stapling on the first copy set of the sheet bundle.

Therefore, to secure a time for execution of side stapling, the buffering process for causing the sheet to be temporarily held back in the buffer path 113 is performed within the sheet processing apparatus 100.

Specifically, as shown in FIG. 4, let it be assumed that a sheet S1 (preceding sheet) to be buffered is conveyed from the copying machine 300 to the sheet processing apparatus 100. The sheet S1 is conveyed through the inlet roller pair 102, the shift unit 108, the conveying roller 110 and the separation roller 111, and the flapper 114 toward the buffer roller pair 115. At this time, the flapper 114 is held by the associated solenoid in an operating state for guiding the sheet S1 to the buffer roller pair 115. Further, the flapper 118 is held by the associated solenoid in an operating state for selecting the bundle-conveying path 121.

When the sheet S1 is being conveyed, if it is detected based on the output from the buffer sensor 109 that the leading end of the sheet S1 has reached the buffer sensor 109, the measurement of the conveying amount of the sheet S1 is started with reference to timing of the detection. The measurement of the conveying amount of the sheet S1 is performed based on the conveying speed of the sheet S1 (rotational speed of the conveying motor M1) and a time period which has elapsed after the above-mentioned timing of the detection.

When the measured conveying amount of the sheet S1 reaches a value Z1 (mm), it is judged to be time to cause normal rotation of the buffer roller pair 115, so that the buffer motor M2 is started so as to cause normal rotation of the buffer roller pair 115. This causes the sheet S1 to be guided via the flapper 118 into the bundle-conveying path 121. It should be noted that the buffer motor M2 rotates and stops each of the buffer roller pairs 112 and 115 in the interlocked manner, and hence if the buffer roller pair 115 performs normal rotation, the buffer roller pair 112 also performs normal rotation in a manner interlocked therewith.

Next, if it is detected that the leading end of the sheet S1 has reached the buffer sensor 116 based on the output therefrom, the measurement of the conveying amount of the sheet S1 is started with reference to timing of this detection. The measurement of the conveying amount of the sheet S1 is performed based on the conveying speed (rotational speed of the buffer motor M2) of the sheet S1 and a time period which has elapsed after the above-mentioned timing of the detection.

If the measured conveying amount of the sheet S1 reaches a value Z2 (mm), it is judged to be time to stop the buffer roller pair 115, so that the buffer motor M2 is stopped. That is, the buffer roller pair 115 is stopped, and hence the conveyance of the sheet S1 is stopped. It should be noted that the conveying amount Z2 is an amount of conveyance which brings the trailing end of the sheet S1 to a position PA. The position PA is at least downstream of a position where the conveying path 103 and the buffer path 113 meet, i.e. downstream of the flapper 114. Therefore, the conveying amount Z2 is an amount determined depending on the size of the sheet S1 in the conveying direction, and the size of the sheet S1 in the conveying direction is notified by the CPU circuit section 305 in advance.

If the conveyance of the sheet S1 is stopped, the flapper 114 is driven by the associated solenoid, and is moved to the position for guiding the sheet S1 into the buffer path 113. Further, the buffer motor M2 is started such that the rotation of the stopped buffer roller pair 115 is reversed. As shown in FIG. 5, this causes the sheet S1 to be guided via the flapper 114 into the buffer path 113. Then, the sheet S1 is conveyed by the buffer roller pair 112 the rotation of which is reversed in the manner interlocked with the buffer roller pair 115, such that part of the sheet S1 is received into the buffer path 113.

The conveyance of the sheet S1 is carried out until the leading end of the sheet S1 has passed the buffer sensor 116, and reaches a position PB determined in advance. Further, when the leading end of the sheet S1 reaches the position PB, the conveyance of the sheet S1 is stopped. That is, the sheet S1 is conveyed by a conveying amount Z3 (mm) from the buffer sensor 116, and then, is stopped. This measurement of the conveying amount of the sheet S1 is carried out based on the conveying speed of the sheet S1 (rotational speed of the buffer motor M2) and a time period which has elapsed after timing at which it is detected that the leading end of the sheet S1 has passed the buffer sensor 116.

When the conveying amount of the sheet S1 from the buffer sensor 116 reaches the value Z3 (mm), it is judged to be time to stop the buffer roller pair 112 (115). Then, the buffer motor M2 is stopped, whereby the buffer roller pair 112 is stopped. This causes the sheet S1 to be stopped in a state where the leading end thereof reaches the position PB. That is, the sheet S1 is caused to be halfway sidetracked into the buffer path 113, thereby being caused to be temporarily held back therein. When the conveyance of the sheet S1 is stopped, the flapper 114 is driven by the associated solenoid, and is returned to the position for guiding the sheet S1 toward the buffer roller pair 115.

When the sheet S1 is caused to be halfway sidetracked into the buffer path 113, a next sheet S2 (following sheet) following the sheet S1 is conveyed into the sheet processing apparatus 100, and is conveyed toward the buffer roller pair 115. Here, when the sheet S2 is conveyed by the conveying amount Z1 (mm) after it is detected that the leading end of the sheet S2 has reached the buffer sensor 109, the buffer roller pair 112 is caused to perform normal rotation, whereby the sheet S1 held back in the buffer path 113 is sent out from the buffer path 113. As shown in FIG. 6, this causes the sheet S1 to have the sheet 52 superposed thereon in a state where the conveying speed of the sheet S1 is equal to the conveying speed of the sheet S2, at a position before the buffer roller pair 115 (i.e. at a position downstream of the position PB). Then, the sheet 51 and the sheet 52 are conveyed toward the bundle-conveying path 121 in a superposed state (as one sheet bundle). It should be noted that the sheet S1 has the sheet S2 superposed thereon with a predetermined offset amount provided between the leading end of the sheet S1 and the leading end of the sheet S2 in the conveying direction of sheet. More specifically, the sheet S1 and the sheet S2 are superposed one upon the other in a state where the leading end of the sheet S2 is forward of the leading end of the sheet S1 by the predetermined amount.

The conveying amount Z1 is a variable for determining timing for starting rotation of the buffer roller pairs 115 and 112 (timing for starting the buffer motor M2). That is, the conveying amount Z1 determines timing for starting the buffer motor M2 so as to send out the sheet S1 held back in the buffer path 113 therefrom. By adjusting the conveying amount Z1, it is possible to superpose the sheet S1 and the sheet S2 in a state offset by a predetermined offset amount (displacement amount). The adjustment of the conveying amount Z1 (i.e. adjustment of the offset amount) will be described hereinafter.

Here, although the description has been given of a case where the two sheets S1 and S2 are superposed, this is not limitative, it is possible to superpose more than two sheets. For example, in a case where a next sheet S3 is superposed on the superposed sheets S1 and S2, the superposed sheets S1 and S2 are caused to be halfway sidetracked into the buffer path 113 by the same operation as described above. Next, when the sheet S3 is conveyed by the conveying amount Z1 after it is detected that the leading end of the sheet S3 has reached the buffer sensor 109, the sheets S1 and S2 are sent out from the buffer path 113 in the superposed state. Then, the sheet S1 and S2, and the sheet S3 are conveyed in an superposed state. At this time, the sheet S3 is superposed in a state where there is a predetermined offset amount between the leading end thereof and the leading end of the sheet 52.

As described above, a plurality of sheets superposed by the buffering process are conveyed to the side stapling unit 150 by the buffer roller pair 122 and the bundle-conveying roller pair 124 as one sheet bundle.

Figure 7:
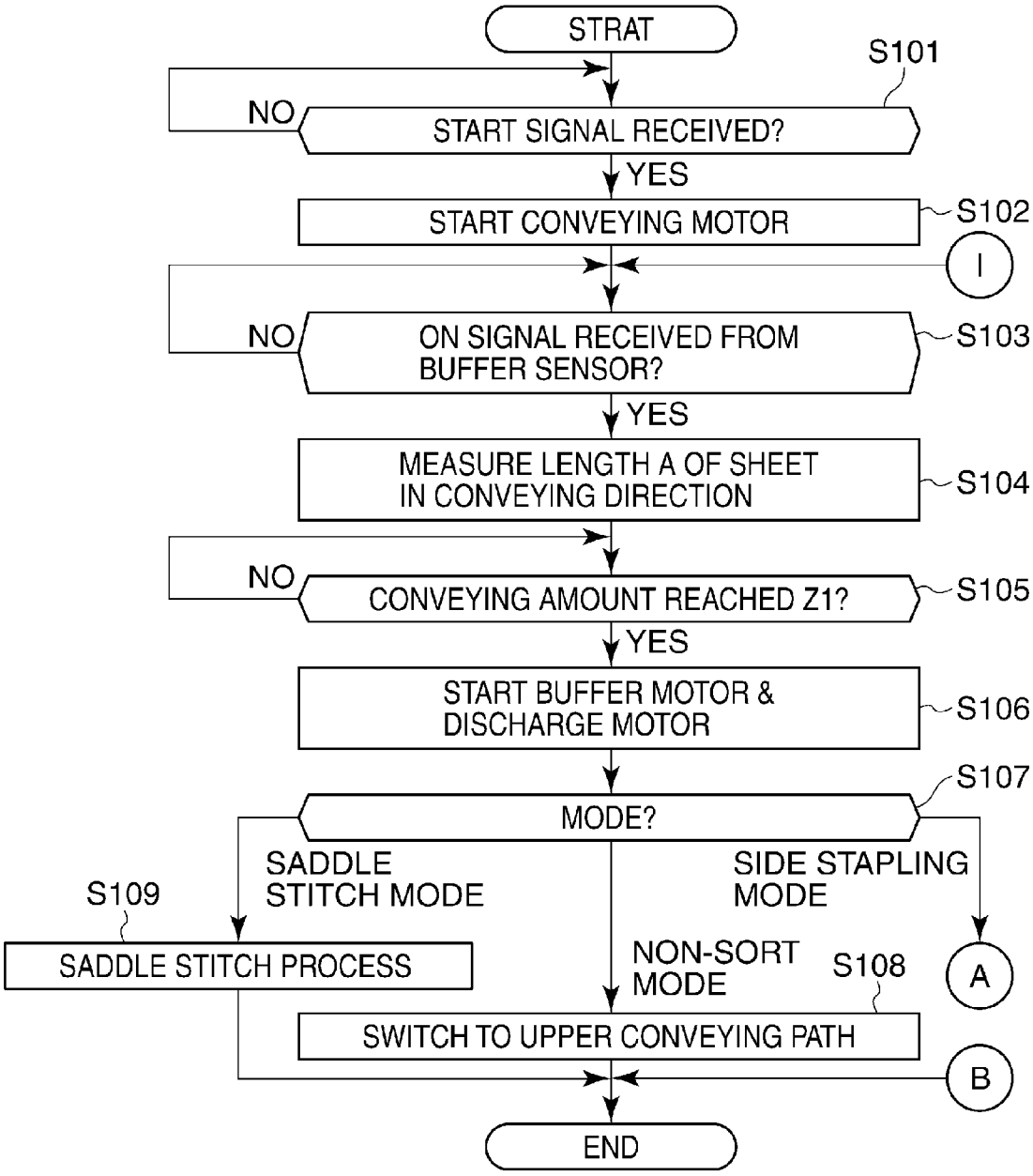
FIG. 7 is a flowchart of a sheet conveyance control process performed by the sheet processing apparatus 100.
Figure 8A:
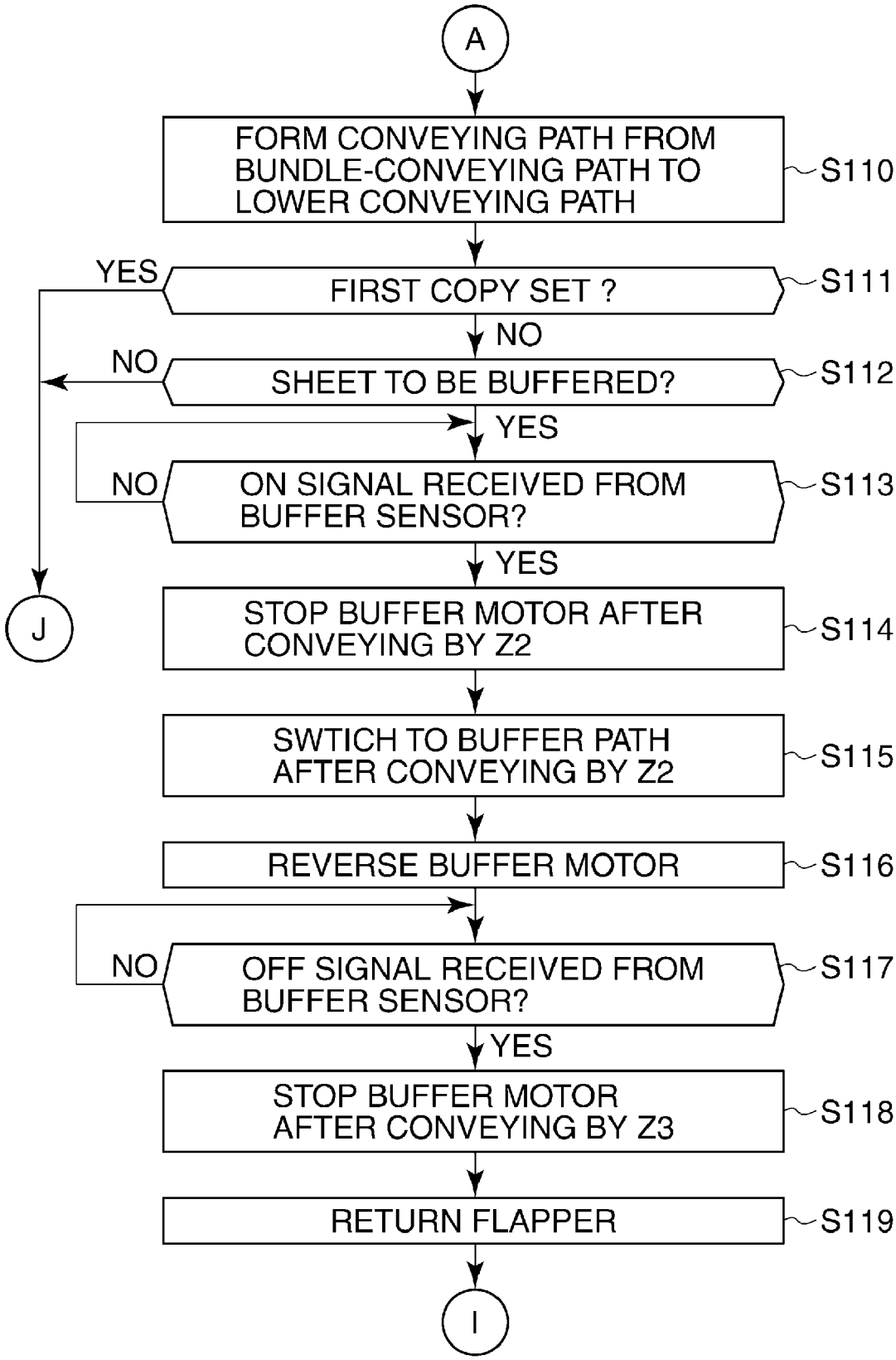
FIGS. 8A and 8B are a continuation of FIG. 7.
Figure 8B:
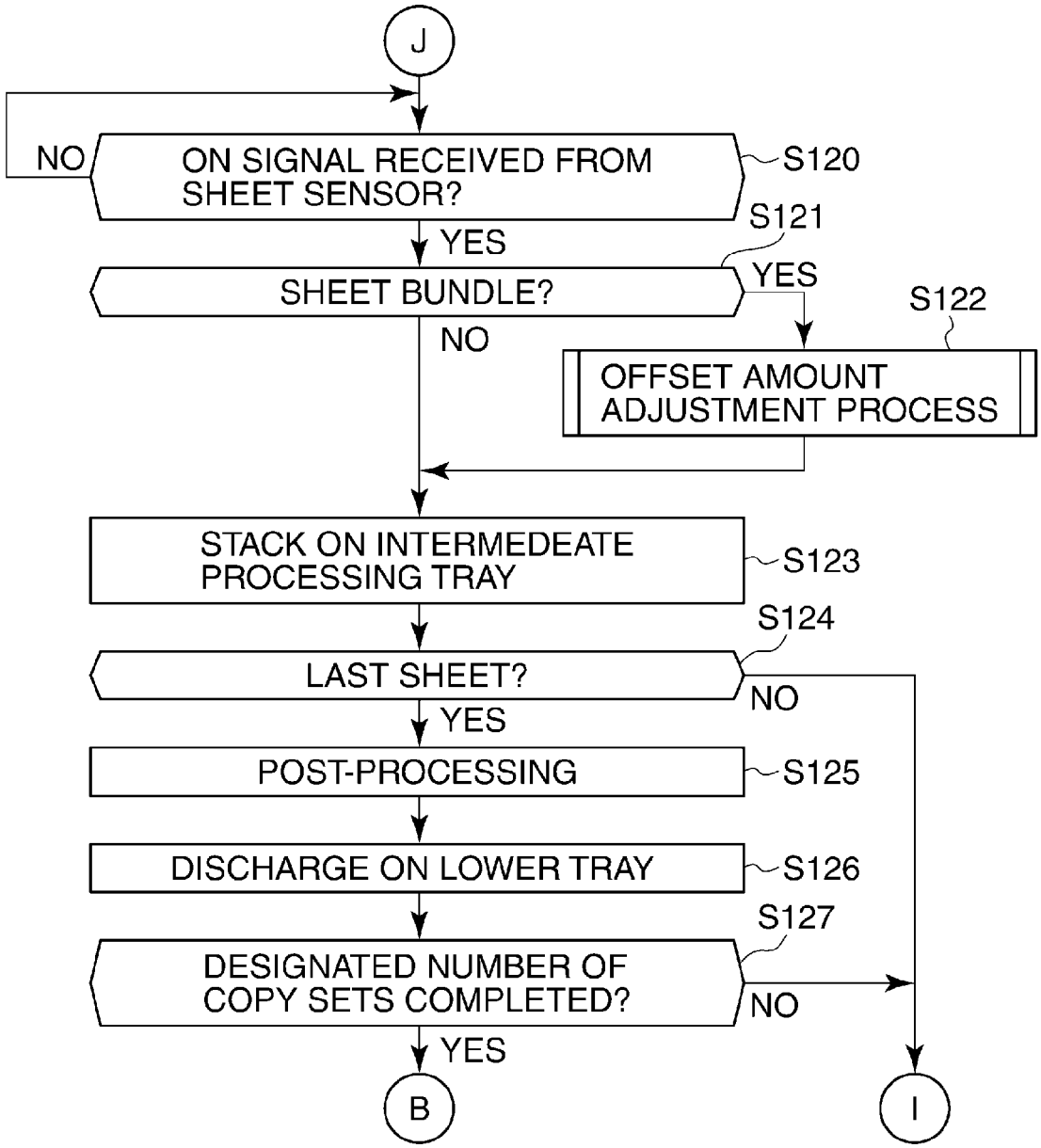

Next, a description will be given of sheet conveyance control by the controller 501 of the sheet processing apparatus 100 with reference to FIGS. 7, 8A and 8B. FIGS. 7, 8A and 8B are flowcharts of a sheet conveyance control process performed by the controller 501 of the sheet processing apparatus 100. The sheet conveyance control process shown in the flowcharts in FIGS. 7, 8A and 8B is executed by the CPU 401 of the controller 501, according to programs stored in the ROM 402.

In the present embodiment, sheets are discharged from the copying machine 300 to the sheet processing apparatus 100 one by one, and the sheet processing apparatus 100 controls the conveyance and post-processing of the sheets discharged from the copying machine 300. Therefore, the controller 950 of the copying machine 300 issues a start signal indicative of the start of image formation sheet by sheet to deliver the start signal to the controller 501 of the sheet processing apparatus 100. Further, control information is transmitted from the controller 950 to the controller 501 together with the above-mentioned start signal for each sheet. This control information contains information indicative of a process to be executed on the sheet (i.e. indicative of a mode), and information indicative of what number-th sheet of what number-th copy set. The controller 501 performs the control based on the control information.

Specifically, as shown in FIG. 7, the controller 501 (CPU 401) waits for reception of the start signal from the controller 950 of the copying machine 300 (step S101). When the controller 501 receives the start signal, the controller 501 starts the conveying motor M1 (step S102). The start of the conveying motor M1 causes the inlet roller pair 102, each of the shift roller pairs 105 and 106, and the conveying roller 110 to be driven for rotation, and causes the sheet conveyed from the copying machine 300 to be conveyed toward the buffer roller pair 115. It should be noted that the shift unit 108 adjusts displacement of the conveyed sheet from the reference position. Further, the flapper 114 is usually in the position for guiding the sheet to the buffer roller pair 115, and is moved to the position for guiding the sheet into the buffer path 113 during execution of the buffering process.

Next, the controller 501 waits for reception of an ON signal from the buffer sensor 109 (step S103). When the ON signal is received from the buffer sensor 109, the controller 501 starts measuring the length A of the sheet in the conveying direction (step S104). The measurement of the length A of the sheet in the conveying direction is carried out based on a time period from when the ON signal is received from the buffer sensor 109 by the controller 501 to when the OFF signal by the same (detection results of the buffer sensor 109) is received, and the conveying speed of the sheet (rotational speed of the conveying motor M1). Further, the controller 501 also starts measuring the conveying amount of the sheet, and waits for the conveying amount to reach the value Z1 (mm) (step S105). Then, when the conveying amount of the sheet reaches the value Z1 (mm), the controller 501 starts the buffer motor M2 and the discharge motor M3 (step S106). At this time, the buffer roller pair 115 is normally rotated by the buffer motor M2. The buffer roller pair 112 is normally rotated in the manner interlocked with the normal rotation of the buffer roller pair 115. Further, the upper discharge roller pair 120, the buffer roller pair 122, the bundle-conveying roller pair 124, and the lower discharge roller pair 128 are rotated by the discharge motor M3.

Next, based on the control information from the controller 950, the controller 501 determines which of a non-sort mode, a side stapling mode, and a saddle stitch mode, is set as a process (mode) to be executed on the sheet (step S107). In this step, if the non-sort mode is set, the controller 501 drives the solenoid associated with the flapper 118 to move the flapper 118 to the position for guiding the sheet into the upper conveying path 117 (step S108). Therefore, in the non-sort mode, the sheet is guided into the upper conveying path 117 and is discharged onto the upper tray 136 by the upper discharge roller pair 120. Thus, in the non-sort mode, the buffering process is not carried out, and sheets are discharged onto the upper tray 136 one by one.

If it is determined in the step S107 that the saddle stitch mode is set, the controller 501 conveys the sheet to the saddle stitch unit 135, and causes a saddle stitching process to be executed on the sheet (step S109). In this case, a conveying path extending from the bundle-conveying path 121 to the saddle stitch path 133 is set by the flappers 118 and 125, and the sheet is conveyed to the saddle stitch unit 135. Description of the control of the saddle stitching process is omitted.

If it is determined in the step S107 that the side stapling mode is set, the process proceeds to a step S110 in FIG. 8A, wherein the controller 501 controls the associated solenoid, not shown, such that the sheet is conveyed from the bundle-conveying path 121 into the lower conveying path 126 (step S110). At this time, the flapper 118 is moved to the position for guiding the sheet into the bundle-conveying path 121 by the associated solenoid, and the flapper 125 is moved to the position for guiding the sheet into the lower conveying path 126 by the associated solenoid.

Next, based on the control information from the controller 950, the controller 501 determines whether or not the sheet is a sheet of a first copy set (a first set of sheets) (step S111). If it is determined in this step that the sheet is a sheet of the first copy set, the controller 501 waits for reception of the ON signal from the sheet sensor 123 (step S120). When the ON signal is received from the sheet sensor 123, the controller 501 determines based on the control information from the controller 950 whether or not what is detected by the sheet sensor 123 is a sheet bundle (step S121). Since the buffering process is not performed on the sheet of the first copy set, it is determined in the step 121 that it is not a sheet bundle, and the controller 501 carries out a process for causing the sheet to be stacked on the intermediate processing tray 138 (step S123). In this process, the sheet is sent via the bundle-conveying path 121 and the lower conveying path 126 to be discharged onto the intermediate processing tray 138 by the lower discharge roller pair 128. It should be noted that when the controller 501 detects based on the output form the sheet sensor 123 that the sheet has reached the sheet sensor 123, the controller 501 starts the swing motor M5 to cause the bundle discharge roller pair 130 to be separated. Then, when the controller 501 detects based on the output from the sheet sensor 127 that the trailing end of the sheet has passed through the lower discharge roller pair 128, the controller 501 drives the paddle 131 and the knurled belt 129. This causes the sheet discharged onto the intermediate processing tray 138 to be conveyed back such that the trailing end of the sheet is brought into abutment with the rear end stopper 138*a* of the intermediate processing tray 138.

As described above, the buffering process is not executed on sheets of the first copy set, and the sheets are discharged onto the intermediate processing tray 138 one by one.

On the other hand, if it is determined in the step S111 that the sheet is not a sheet of the first copy set, the controller 501 determines whether or not the sheet is a sheet to be buffered based on the control information from the controller 950 (step S112). For example, as for the second and subsequent copies, a first sheet and a second sheet of each copy set are regarded as sheets to be buffered (temporarily held back). Therefore, it is determined that a third sheet and subsequent sheets of each of the second and subsequent copies are not sheets to be buffered. In general, sheets to be buffered are determined based on a time required for performing side stapling, and an interval of conveyance of sheets being discharged from the copying machine 300. If it is determined that the sheet is not a sheet to be buffered, this sheet must be a third sheet which is to be superposed on the buffered first and second sheets, or a fourth sheet or subsequent sheets. In this case, the controller 501 waits for reception of the ON signal from the sheet sensor 123 (step S120). When the ON signal is received from the sheet sensor 123, the controller 501 determines based on the control information from the controller 950 whether or not a sheet bundle (sheet bundle formed by superposing the first to third sheets) is detected by the sheet sensor 123 (step S121). If the sheet bundle is detected by the sheet sensor 123, the controller 501 executes an offset amount adjustment process (step S122). The offset amount adjustment process will be described hereinafter. If one sheet is detected by the sheet sensor 123, the sheet is stacked on the intermediate processing tray 138 in the step S123, as described hereinabove.

Then, the controller 501 determines whether or not the sheet discharged onto the intermediate processing tray 138 is the last sheet of one copy set (step S124). In this step, if the sheet is not the last sheet of one copy set, the process returns to the step S103, wherein the controller 501 waits for arrival of the next sheet.

It is determined that the sheet is the last sheet of one copy set in the step S124, the controller 501 staples the sheet bundle stacked on the intermediate processing tray 138 using the stapler 132 (step S125). Then, the controller 501 starts the swing motor M5 to move the bundle discharge roller pair 130 to the position for nipping the stapled sheet bundle, and then, starts the bundle discharge motor M4 to rotate the bundle discharge roller pair 130 (step S126). This causes the stapled sheet bundle to be discharged onto the lower tray 137. Next, the controller 501 determines whether or not the post-processing on a designated number of copy sets is completed (step S127). If there is any copy set (set of sheets) remaining to be post-processed, the process returns to the step S103, wherein the controller 501 waits for arrival of the next sheet. On the other hand, if the post-processing on the designated number of copies has been completed, the controller 501 immediately terminates the present process.

If it is determined in the step S112 that the sheet is a sheet to be buffered, the controller 501 waits for reception of the ON signal (signal indicating that the leading end of the sheet is detected) from the buffer sensor 116 (step S113). If it is determined in this step that the ON signal is received from the buffer sensor 116, the controller 501 causes the sheet to be conveyed by the conveying amount Z2 (mm), and then stops the buffer motor M2 (step S114). This causes the buffer roller pair 115 to be stopped, whereby the sheet is stopped in a state where the rear end thereof has reached the position PA (see FIG. 4).

Next, the controller 501 drives the solenoid associated with the flapper 114 to move the flapper 114 to the position for guiding the sheet into the buffer path 113 (step 115). Then, the controller 501 starts the buffer motor M2 so as to cause reverse rotation of the buffer roller pair 115 (step S116). The buffer roller pair 112 performs reverse rotation in a manner interlocked with the reverse rotation of the buffer roller pair 115. This causes the sheet to be guided via the flapper 114 into the buffer path 113, from its trailing end first.

Next, the controller 501 waits reception of the OFF signal (signal indicating that the leading end of the sheet has passed the buffer sensor 116) from the buffer sensor 116 (step S117). If it is determined in this step that the OFF signal is received from the buffer sensor 116, the controller 501 causes the sheet to be conveyed by the conveying amount Z3 (mm), and then stops the buffer motor M2 (step S118). This causes the buffer roller pair 115 to be stopped, and the sheet is stopped in a state where the leading end thereof has reached the position PB (see FIG. 5). That is, the sheet is caused to be temporarily held back therein.

Next, the controller 501 drives the solenoid associated with the flapper 114 to return the flapper 114 to the initial position (step S119). Then, the process returns to the step S103, wherein the controller 501 waits arrival of the next sheet.

Next, a description will be given of an example of the conveyance of sheets. For example, based on a case where two copies each formed by five sheets S1 to S5 are output, the conveyance of each of sheets S1 to S5 will be described. In this process, it is assumed that two sheets S1 and S2 are sheets to be buffered.

As for the first copy set, the sheets S1 to S5 are each determined to be a sheet of the first copy set, and then are stacked on the intermediate processing tray 138 one by one. When the sheet S5, i.e. the last sheet of the first copy set is stacked on the intermediate processing tray 138, the sheets S1 to S5 are stapled into one bundle by the stapler, and the stapled sheet bundle (the sheets S1 to S5) is discharged onto the lower tray 137.

As for the second copy set, the buffering process is performed on sheets S1 and S2 thereof. It is determined that the sheet S1 is a sheet to be buffered, so that the sheet S1 is caused to be halfway sidetracked into the buffer path 113 in the course of conveyance. The sheet S1 in the buffer path 113 is sent out from the buffer path 113 in timing currently set (corresponding to the conveying amount Z1), and has the sheet S2, which is subsequently conveyed, superposed thereon in an offset state. Then, the sheets S1 and S2 are conveyed as one bundle, and are conveyed back to the buffer path 113 in the course of conveyance. This causes the sheets S1 and S2 to be halfway sidetracked into the buffer path 113.

The superposed sheets S1 and S2 in the buffer path 113 are sent out from the buffer path 113 in timing currently set, and have the sheet S3, which is subsequently conveyed, superposed thereon in an offset set. Then, the sheets S1 to S3 are conveyed as one superposed sheet bundle.

Since the sheet S3 contained in the sheet bundle formed by superposing the sheets S1 to S3 is not a sheet to be buffered, it is determined that the sheet bundle formed by superposing the sheets S1 to S3 is not a sheet to be buffered. Thus, the sheet bundle formed by superposing the sheets S1 to S3 one upon another is conveyed toward the intermediate processing tray 138, and is stacked thereon.

Each of the sheets S4 and S5 is conveyed one by one, following the sheet S3. Since the sheets S4 and S5 are not sheets to be buffered, the sheets S4 and S5 are stacked on the intermediate processing tray 138 one by one. Then, when the sheet S5, i.e. the last sheet of the second copy set is stacked on the intermediate processing tray 138, the sheets S1 to S5 are stapled into one bundle by the stapler 132, and are discharged onto the lower tray 137.

Figure 9:
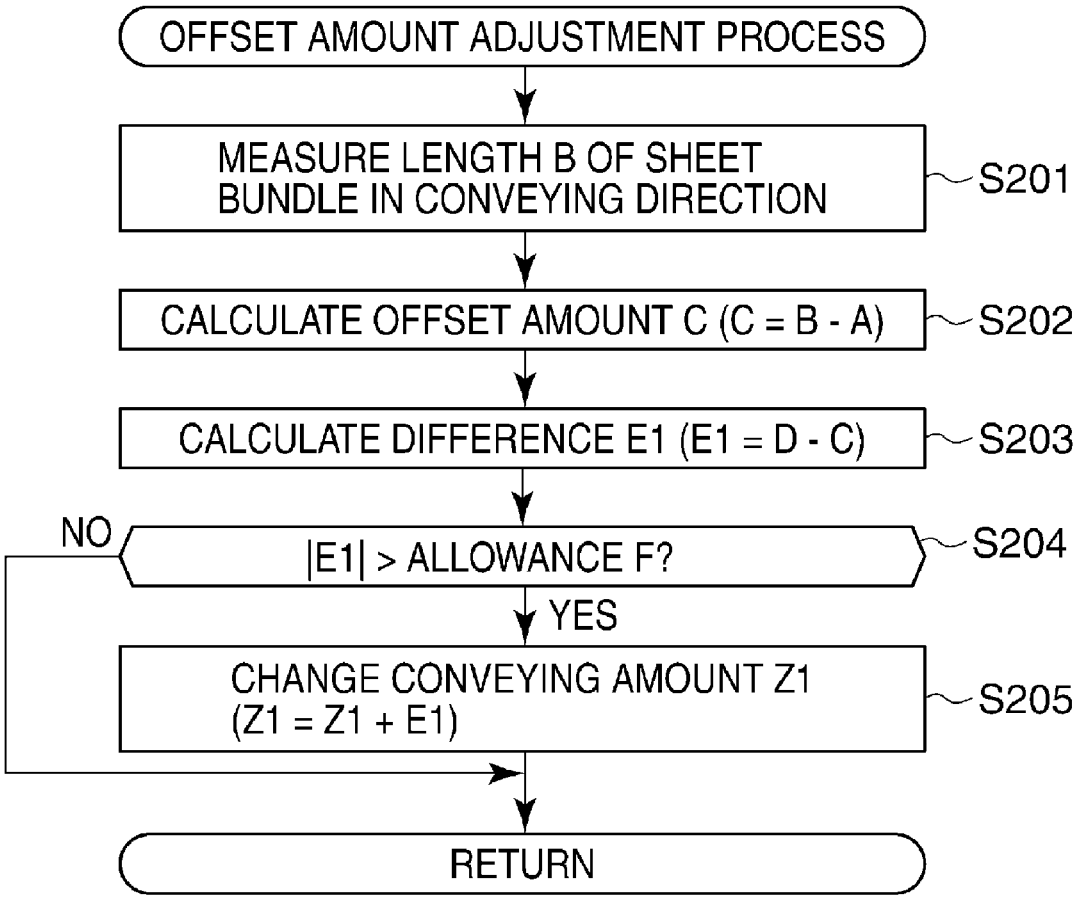
FIG. 9 is a flowchart showing details of an offset amount adjustment process executed in a step in FIG. 8B.

Next, a description will be given of details of the offset amount adjustment process (step S122 in FIG. 8B) with reference to FIG. 9.

In the offset amount adjustment process, the controller 501 measures a length B (mm) of the sheet bundle (sheet bundle formed by superposing the first to third sheets) in the conveying direction (step S201). The measurement of the length B of the sheet bundle in the conveying direction is performed based on a time period from when the ON signal is received from the buffer sensor 116 to when the OFF signal (detection results of the buffer sensor 116) is received from the same and the conveying speed of the sheet (rotational speed of the buffer motor M2).

Next, the controller 501 computes the difference between the length B of the sheet bundle in the conveying direction and the length A of the sheet in the conveying direction (length of the first sheet in the conveying direction) determined in the step S104 as an offset amount C (step S202). The reason for employing the first sheet as the length A of the sheet in the conveying direction is because in the present embodiment, the sheets are offset such that the first sheet forms the trailing end of the sheet bundle formed by superposing the three sheets one upon another. That is, the second sheet does not provide either the leading end or the trailing end of the sheet bundle, the second sheet has no influence on the measurement of the length B of the sheet bundle. Next, the controller 501 computes the difference between an offset target value D and the offset amount C computed in the step S202 as the difference E1 (step S203). The difference E1 is stored in the RAM 403.

Next, the controller 501 determines whether or not the absolute value of the difference E1 is larger than an allowance F (step S204). In this step, if the absolute value of the difference E1 is not larger than the allowance F, it is not required to adjust the offset amount, so that the controller 501 immediately terminates the present process. This causes the currently set conveying amount Z1 to be set as the next conveying amount Z1 without being changed.

On the other hand, if it is determined in the step S204 that the absolute value of the difference E1 is larger than the allowance F, the controller 501 changes the conveying amount Z1 (value for determining the timing for starting the buffer motor M2) currently set (step S205). In this step, the conveying amount Z1 is changed to a conveying amount determined by adding the difference E1 to the conveying amount Z1 currently set, and the changed conveying amount Z1 is set as the conveying amount Z1 when superposing sheets one upon another next time. This is because it is assumed that the sheet bundle having sheets thereof subjected to offset is in a state in which the leading end of an upper sheet of the sheet bundle is displaced downstream of the leading end of a lower sheet of the sheet bundle in the conveying direction. Then, the controller 501 immediately terminates the present process.

As described above, in the present embodiment, when the sheet is being conveyed in the sheet processing apparatus, the offset amount provided when superposing a plurality of sheets one upon another is measured, and the difference between the measurement and the target value is fed back to the sheet conveyance control for superposition of sheets next time. Therefore, even if the sheet passing through the fixing device of the image forming apparatus is contracted or extended, it is possible to reduce variation of the offset amount. Further, even when the accuracy of cutting standard-size sheets is low, making the actual length of each sheet does different from a designated value, it is possible to reduce variation in the offset amount.

In the above-described embodiment, the description has been given assuming that the buffering process is not performed on the sheets of the first copy set. However, also on the sheets of the first copy set, the buffering process (superposition of sheets) may be performed, and the offset amount adjustment process in the step S122 may be performed.

Further, in the above-described embodiment, the description was given assuming that in the case where the side stapling mode is designated, the offset amount adjustment process is executed. However, irrespective of whether or not the side stapling mode is designated, if it is required to perform the buffering process, the offset amount adjustment process may be executed. That is, in the saddle stitch mode, or a mode in which sheets are discharged onto the intermediate processing tray 138, the offset amount adjustment process may be executed.

Further, if the offset amount becomes too large due to abnormality of the apparatus, i.e. if the computed offset amount C exceeds a predetermined value, the fact that the apparatus suffers from abnormality may be displayed on the console section 308 without executing the offset amount adjustment process.

Further, the function of the offset amount adjustment process may be eliminated, and if the offset amount C exceeds the predetermined value, the fact that the apparatus suffers from abnormality may be displayed on the console section 308, and the sheet conveyance requiring the buffering process may be inhibited. In this case, if the offset amount C is not more than the predetermined value, the normal sheet conveyance control is carried out.

Figure 10:
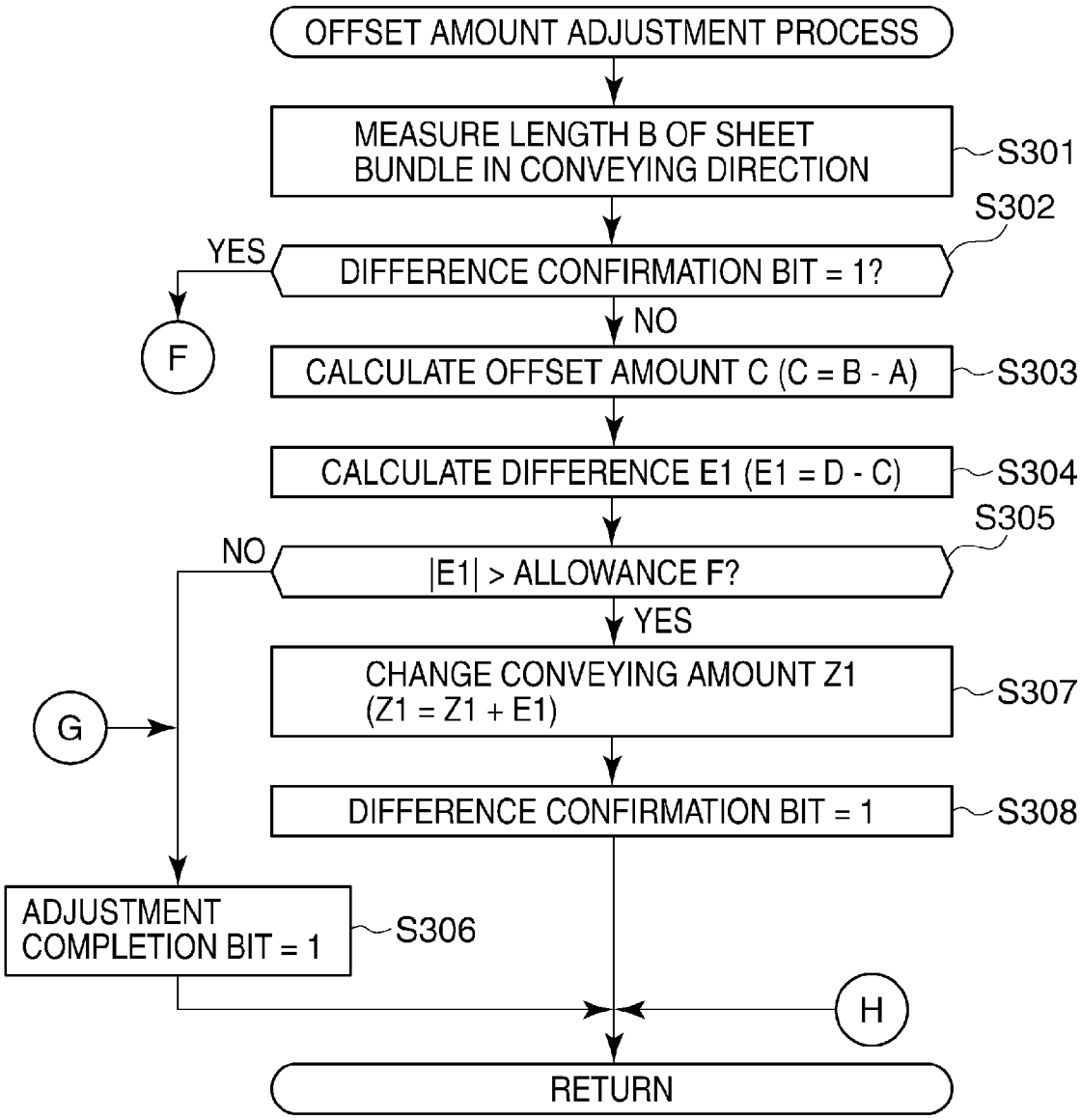
FIG. 10 is a flowchart of details of an offset amount adjustment process executed as an adjustment mode by a sheet processing apparatus according to a second embodiment of the present invention.
Figure 11:
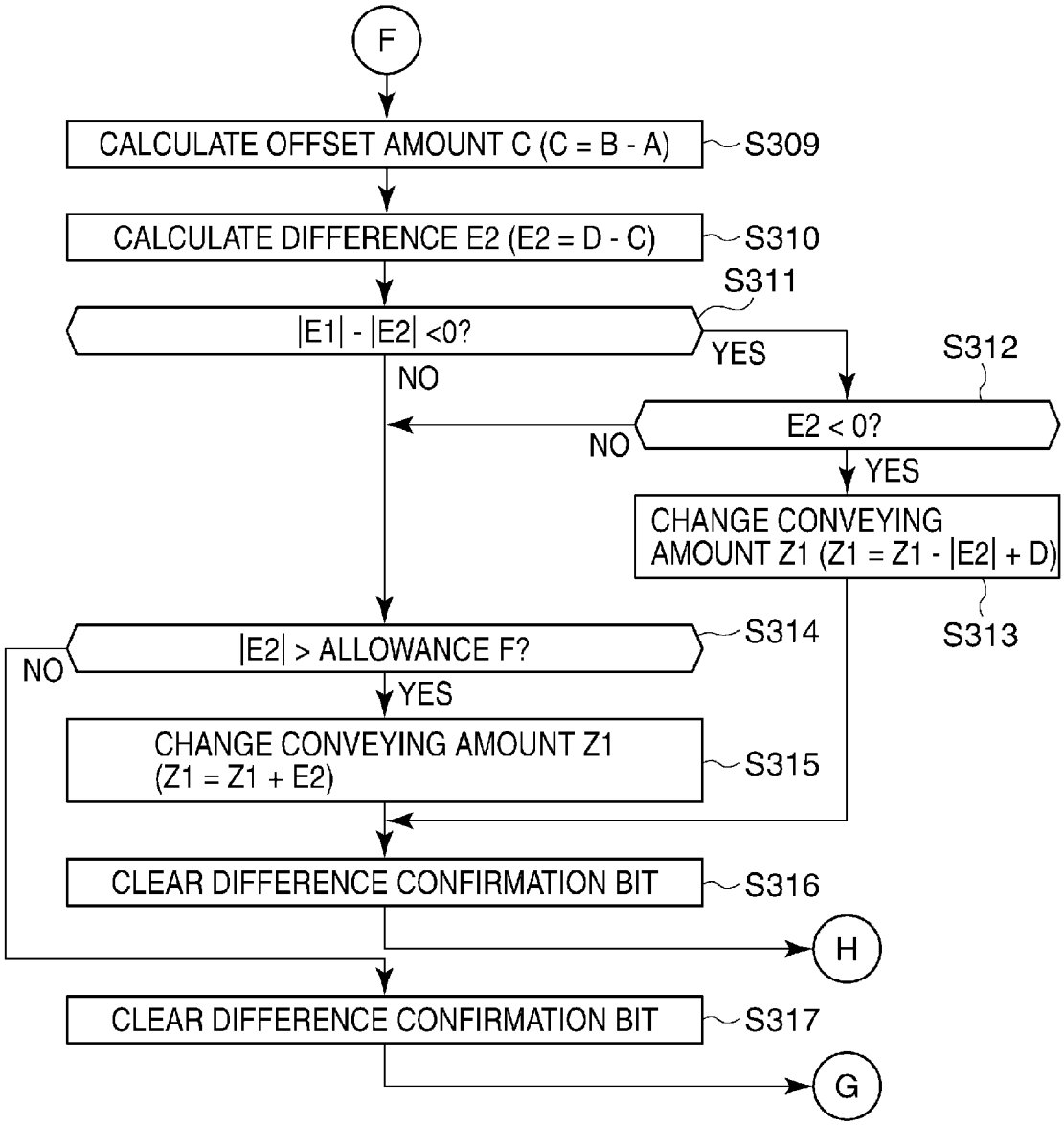
FIG. 11 is a continuation of FIG. 10.
Figure 12:
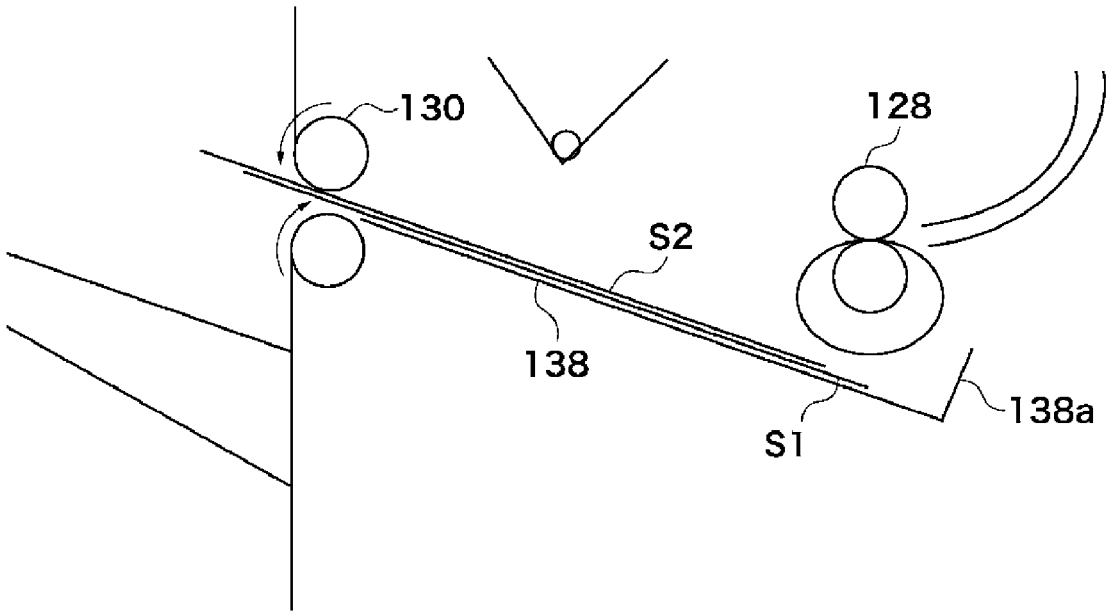
FIG. 12 is a view schematically showing a state in which a sheet bundle formed by a plurality of superposed sheets is discharged onto an intermediate processing tray.

Next, a second embodiment of the invention will be described. Instead of executing the above-described offset amount adjustment process during the normal sheet conveyance control (along with image forming operation) as in the first embodiment described above, the offset amount adjustment process may be executed by a user or a serviceman at another timing independently of the image forming operation. For example, execution of the offset amount adjustment process may be instructed as an adjustment mode from the console section 308. According to this instruction, the image forming apparatus discharges a plurality of blank sheets to the sheet processing apparatus, and the sheet processing apparatus executes the buffering process. The control process executed at this time is the same as described hereinbefore with reference to FIGS. 7, 8A, and 8B. However, the designated number of sets in the step S127 is assumed to be set to two. Further, as the offset amount adjustment process in the step S122, an offset amount adjustment control process shown in FIGS. 10 and 11 is executed. The second embodiment is mainly distinguished from the first embodiment in this process, and is identical in construction to the first embodiment. Therefore, description of the construction is omitted, and component parts are denoted by same reference numeral.

A description will be given of the offset amount adjustment process as the adjustment mode with reference to FIGS. 10 and 11.

The controller 501 measures the length B (mm) of the sheet bundle (sheet bundle formed by superposing the first to third sheets) in the conveying direction (step S301). The measurement of the length B of the sheet bundle in the conveying direction is performed in the same manner as in the step S201.

Next, the controller 501 determines whether or not a difference confirmation bit is equal to 1 (step S302). The difference confirmation bit is used for indicating that the absolute value of the difference between the measured offset amount and the target value is not more than the allowance. If the value of the difference confirmation bit is equal to 1, the difference confirmation bit indicates that the difference is not more than the allowance, whereas if the value is not equal to 1, the difference confirmation bit indicates that it is not confirmed that the difference is not more than the allowance.

If it is determined that the difference confirmation bit is not equal to 1 in the step S302, the controller 501 carries out the same processing as executed in the steps S202 and S203 (steps S303 and S304).

Next, the controller 501 determines whether or not the absolute value of the difference E1 is larger than the allowance F (step S305). If it is determined in this step that the absolute value of the difference E1 is not larger than the allowance F, the controller 501 sets the adjustment completion bit to 1 (step S306), followed by terminating the present process. This causes the currently set conveying amount Z1 to be set to the next conveying amount without being changed.

On the other hand, if it is determined in the step 305 that the absolute value of the difference E1 is larger than the allowance F, the controller 501 carries out the same processing as in the step S205 (S307). Then, the controller 501 sets the difference confirmation bit to 1 (step S308), followed by terminating the present process.

If it is determined in the step S302 that the displacement direction confirmation bit is equal to 1, the controller 501 computes the difference between the length B of the sheet bundle in the conveying direction and the length A of the sheet in the conveying direction as the offset amount C (step S309). Then, the controller 501 computes the difference between the offset target value D and the offset amount C computed in the step S309 as the difference E2 (step S310).

Next, the controller 501 determines whether or not the following relational expression is satisfied between the absolute value of the difference E1 computed last time and the absolute value of the difference E2 measured this time (step S311).

$$|E1|-|E2|<0$$

If the relational expression |E1|−|E2|<0 is satisfied, the controller 501 determines whether or not the value E2 is less than 0 (S312). If the relational expressions |E1|−|E2|<0 and E2<0 are satisfied, it is a case where the difference is more increased by changing the preceding conveying amount Z1 (step S307). That is, in this case, the leading end of an upper sheet (second sheet) of the sheet bundle is more largely displaced downstream of the leading end of a lower sheet (first sheet) in the conveying direction. Then, the controller 501 again changes the conveying amount Z1 currently set (step S313). In this case, the conveying amount Z1 is changed to a value (Z1−|E2|+D) obtained by subtracting the absolute value of the difference E2 from the conveying amount Z1 currently set, and adding the offset target value D to the resulting difference. The changed conveying amount Z1 is set as the conveying amount Z1 when executing the buffering process in the normal sheet conveyance control. Then, the controller 501 clears the value of the difference confirmation bit (step S316), followed by terminating the present process.

If it is determined in the step S311 that the relational expression |E1|−|E2|<0 is not satisfied, the controller 501 determines whether or not the absolute value of the difference E2 is larger than the allowance F (step S314). If it is determined in this step that the absolute value of the difference E2 is larger than the allowance F, the controller 501 changes the conveying amount Z1 currently set (step S315). In this case, the conveying amount Z1 is changed to a conveying amount obtained by adding the difference E2 to the current conveying amount Z1, and the changed conveying amount Z1 is set as the conveying amount Z1 when executing the time buffering process in the normal sheet conveyance control. Then, the controller 501 clears the value of the difference confirmation bit (step S316), followed by terminating the present process.

If it is determined in the step S314 that the absolute value of the difference E2 is not larger than the allowance F, the controller 501 clears the value of the displacement direction confirmation bit (step S317). Then, the controller 501 sets the adjustment completion bit to 1 (step S306), followed by terminating the present process.

As described above, in the offset amount adjustment process executed as the adjustment mode, the current offset amount provided when a sheet to be buffered and the following sheet are superposed during the normal sheet conveyance control is adjusted. In the offset amount adjustment, the start timing (Z1) is changed depending on whether or not the offset amount currently set by the start timing (Z1) is within an allowable range, and the changed start timing is set as a next start timing. As a result, it is possible to positively superpose the sheet to be buffered and the following sheet, one upon the other, with an allowable offset amount, whereby it is possible to suppress generation of misalignment.

It should be noted that the above-described offset amount adjustment process may be performed as one executed in the normal sheet conveyance control (along with image forming operation).

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-253843, filed Sep. 30, 2008, and Japanese Patent Application No. 2009-221833, filed Sep. 28, 2009, which are hereby incorporated by reference herein in its entirety.

What is claimed is:

1. A sheet processing apparatus for performing post-processing on sheets conveyed from an image forming apparatus, comprising:

a buffer section configured to cause a sheet conveyed from the image forming apparatus to be temporarily held back therein, and superpose the held-back sheet and a following sheet in a state displaced in a conveying direction of the sheet;

a tray configured to stack thereon a sheet bundle superposed by said buffer section and conveyed;

an alignment unit configured to align the sheet bundle stacked on said tray in the conveying direction;

a first measurement section configured to measure a length in the conveying direction of the sheet to be held back in said buffer section;

a second measurement section configured to measure a length in the conveying direction of the sheet bundle of the superposed sheets; and an adjustment section configured to adjust a displacement amount in the conveying direction of the sheets superposed by said buffer section, said adjustment section adjusting the displacement amount, such that a difference between a result of measurement by said first measurement section and a result of measurement by said second measurement section is caused to be a target amount.

2. The sheet processing apparatus according to claim 1, wherein said buffer section superposes the sheet caused to be held back therein and the following sheet in the state displaced in the conveying direction by conveying the sheet caused to be held back therein at a predetermined timing, wherein said adjustment section adjusts the displacement amount in the conveying direction of the sheets superposed by said buffer section by adjusting the predetermined timing.

3. The sheet processing apparatus according to claim 2, wherein said adjustment section makes the predetermined timing earlier or later by a time period corresponding to a difference between the displacement amount and the target amount.

4. The sheet processing apparatus according to claim 2, wherein said buffer section superposes the sheet caused to be held back therein and the following sheet in the state displaced in the conveying direction, by conveying, when the following sheet is conveyed by a predetermined amount from a predetermined position in a sheet-conveying path, the sheet held back therein to the sheet-conveying path.

5. The sheet processing apparatus according to claim 1, wherein said adjustment section does not perform the adjustment of the displacement amount if an absolute value of a difference between the displacement amount and the target amount is not more than an allowance, but performs the adjustment of the displacement amount if the absolute value of the difference between the displacement amount and the target displacement amount is more than the allowance.

6. The sheet processing apparatus according to claim 1, the first measurement section comprising a first sensor provided upstream of said buffer section, for detecting a sheet, wherein said first measurement section measures the length of the sheet based on a time period from when said first sensor detects a leading end of the sheet to when said first sensor detects a trailing end of the sheet, and a conveying speed of the sheet.

7. The sheet processing apparatus according to claim 6, the second measurement section comprising a second sensor provided downstream of said buffer section, for detecting a sheet, wherein said second measurement section measures a length of the sheet bundle based on a time period from when said second sensor detects a leading end of the sheet bundle to when said second sensor detects a trailing end of the sheet bundle, and a conveying speed of the sheet bundle.

8. The sheet processing apparatus according to claim 1, wherein said buffer section superposes the sheet caused to be held back therein and the following sheet, such that the leading end of the following sheet is displaced downstream of the leading end of the sheet caused to be held back therein in the conveying direction, wherein said adjustment section adjusts adjust the displacement amount of the sheets superposed by said buffer section, the displacement amount being a difference between a length of a sheet which is to form a lowest sheet in the sheet bundle, measured by said first measurement section, and the length of the sheet bundle, measured by said second measurement section, such that the displacement amount is caused to be the target amount.

9. A sheet processing apparatus for performing post-processing on sheets conveyed from an image forming apparatus, comprising:

a buffer section configured to cause a sheet conveyed from the image forming apparatus to be temporarily held back therein, and superpose the held-back sheet and a following sheet in a state displaced in a conveying direction of the sheet;

a tray configured to stack thereon a sheet bundle superposed by said buffer section and conveyed;

an alignment unit configured to align the sheet bundle stacked on said tray in the conveying direction;

a first measurement section configured to measure a length in the conveying direction of the sheet to be held back in said buffer section;

a second measurement section configured to measure a length in the conveying direction of the sheet bundle of the superposed sheets; and a computing section configured to compute a displacement amount in the conveying direction of the sheets superposed by said buffer section based on a difference between a result of measurement by said first measurement section and a result of measurement by said second measurement section.

10. The sheet processing apparatus according to claim 9, wherein said computing section notifies an error, if the computed displacement amount exceeds a predetermined value.

* * * * *